US007871510B2

(12) United States Patent
Leta et al.

(10) Patent No.: US 7,871,510 B2
(45) Date of Patent: Jan. 18, 2011

(54) PRODUCTION OF AN ENHANCED RESID COKER FEED USING ULTRAFILTRATION

(75) Inventors: Daniel P. Leta, Flemington, NJ (US); Leo D. Brown, Baton Rouge, LA (US); Michael Siskin, Randolph, NJ (US)

(73) Assignee: ExxonMobil Research & Engineering Co., Annadale, NJ (US)

( * ) Notice: Subject to any disclaimer, the term of this patent is extended or adjusted under 35 U.S.C. 154(b) by 276 days.

(21) Appl. No.: 11/980,158

(22) Filed: Oct. 30, 2007

(65) Prior Publication Data

US 2009/0057196 A1 Mar. 5, 2009

Related U.S. Application Data

(60) Provisional application No. 60/966,518, filed on Aug. 28, 2007.

(51) Int. Cl.
*C10G 55/04* (2006.01)
*B01D 61/16* (2006.01)

(52) U.S. Cl. ..... 208/88; 208/85; 208/131; 210/651

(58) Field of Classification Search ..... 208/85, 208/88, 91, 131; 210/651
See application file for complete search history.

(56) References Cited

U.S. PATENT DOCUMENTS

| | | | |
|---|---|---|---|
| 2,947,687 | A | 10/1954 | Lee |
| 3,558,474 | A | 1/1971 | Gleim et al. |
| 3,617,514 | A | 11/1971 | Marlar |
| 3,684,697 | A | 8/1972 | Gamison |
| 3,707,459 | A | 12/1972 | Mason et al. |
| 3,769,200 | A | 10/1973 | Folkins |
| 3,852,047 | A | 12/1974 | Schlinger et al. |
| 3,919,075 | A | 11/1975 | Parc et al. |
| 3,990,963 | A | 11/1976 | Audibert et al. |
| 4,115,465 | A | 9/1978 | Elfert et al. |
| 4,120,900 | A | 10/1978 | Evers et al. |
| 4,134,824 | A | 1/1979 | Kamm et al. |
| 4,140,623 | A | 2/1979 | Sooter et al. |
| 4,169,782 | A | 10/1979 | Thompson |

(Continued)

FOREIGN PATENT DOCUMENTS

| | | |
|---|---|---|
| CA | 2185264 | 9/1996 |

(Continued)

OTHER PUBLICATIONS

PCT International Search Report.

(Continued)

*Primary Examiner*—Walter D Griffin
*Assistant Examiner*—Renee Robinson
(74) *Attorney, Agent, or Firm*—Glenn T. Barrett; Malcolm D. Keen

(57) ABSTRACT

This invention relates to a high-pressure ultrafiltration process to produce an improved coker feed for producing a substantially free-flowing coke, preferably free-flowing shot coke from an atmospheric and/or vacuum resid feedstock. The process of this invention utilizes a high-pressure ultrafiltration process to produce an intermediate product stream with improved the Conradson Carbon Residue (CCR) content which is utilized in either an improved delayed coking or a fluid coking process.

6 Claims, 8 Drawing Sheets

U.S. PATENT DOCUMENTS 4,259,170 A 3/1981 Graham et al.
4,298,455 A 11/1981 Huang
4,399,024 A 8/1983 Fukui et al.
4,411,770 A 10/1983 Chen et al.
4,411,790 A 10/1983 Arod et al.
4,430,197 A 2/1984 Poynor et al.
4,440,625 A 4/1984 Go et al.
4,455,219 A 6/1984 Janssen et al.
4,504,377 A 3/1985 Shu et al.
4,518,487 A 5/1985 Graf et al.
4,529,501 A 7/1985 George
4,549,934 A 10/1985 Graf et al.
4,592,830 A 6/1986 Howell et al.
4,592,832 A 6/1986 Bristow et al.
4,612,109 A 9/1986 Dillon et al.
4,616,308 A 10/1986 Morshedi et al.
4,617,126 A 10/1986 Funk et al.
4,659,543 A 4/1987 Lui
4,661,241 A 4/1987 Dabkowski et al.
4,797,200 A 1/1989 Osterhuber
4,814,088 A 3/1989 Kutowy et al.
4,816,140 A 3/1989 Trambouze et al.
4,874,523 A 10/1989 LaFreniere
4,892,660 A 1/1990 Sweet
4,908,134 A 3/1990 Anderson
4,927,561 A 5/1990 Forester
4,946,594 A 8/1990 Thaler et al.
4,963,303 A 10/1990 Anderson
4,978,454 A 12/1990 Sweet
4,982,051 A 1/1991 Pasternak et al.
5,045,206 A 9/1991 Chen et al.
5,045,354 A 9/1991 Feimer et al.
5,107,056 A 4/1992 Chen et al.
5,107,058 A 4/1992 Chen et al.
5,107,059 A 4/1992 Chen et al.
5,160,602 A 11/1992 Becraft et al.
5,173,172 A 12/1992 Adams et al.
5,180,496 A 1/1993 Sartori et al.
5,191,151 A 3/1993 Eriksen et al.
5,248,410 A 9/1993 Clausen et al.
5,256,297 A 10/1993 Feimer et al.
5,258,115 A 11/1993 Heck et al.
5,460,714 A 10/1995 Fixari et al.
5,514,252 A 5/1996 Kerby, Jr. et al.
5,635,055 A 6/1997 Sweet et al.
5,643,442 A 7/1997 Sweet et al.
5,645,711 A 7/1997 Hraban et al.
5,749,943 A 5/1998 Shimazu et al.
5,785,860 A 7/1998 Smith
5,820,750 A 10/1998 Blum et al.
5,853,565 A * 12/1998 Cayton ..... 208/48 AA
5,979,178 A 11/1999 Engler et al.
6,048,904 A 4/2000 Wiehe et al.
6,168,709 B1 1/2001 Etter
6,180,008 B1 1/2001 White
6,187,987 B1 2/2001 Chin et al.
6,190,533 B1 2/2001 Bradow et al.
6,193,875 B1 2/2001 Pereira et al.
6,264,829 B1 7/2001 Antalffy et al.
6,387,840 B1 5/2002 Salazar et al.
6,524,469 B1 2/2003 Schucker
6,525,469 B1 2/2003 Huang et al.
6,611,735 B1 8/2003 Henly et al.
6,660,131 B2 12/2003 Lah
6,896,796 B2 5/2005 White et al.
7,018,517 B2 3/2006 Kurita et al.
7,041,212 B2 5/2006 White et al.
7,048,846 B2 5/2006 White et al.
2002/0033265 A1 3/2002 Varadaraj
2002/0125174 A1 9/2002 Varadaraj
2002/0161059 A1 10/2002 Varadaraj et al.
2003/0019790 A1 1/2003 Schucker
2003/0127314 A1 7/2003 Bell et al.
2003/0132139 A1 7/2003 Varadaraj
2003/0191194 A1 10/2003 Varadaraj
2004/0026321 A1 2/2004 Minhas et al.
2004/0035749 A1 2/2004 Khan et al.
2004/0251166 A1 12/2004 Alvarenga Baptista et al.
2004/0251201 A1 12/2004 Chau et al.
2004/0256292 A1 12/2004 Siskin et al.
2004/0262198 A1 12/2004 Siskin et al.
2005/0258070 A1 11/2005 Varadaraj et al.
2005/0258071 A1 11/2005 Varadaraj et al.
2005/0258075 A1 11/2005 Varadaraj et al.
2005/0263438 A1 12/2005 Varadaraj et al.
2005/0263440 A1 12/2005 Varadaraj et al.
2005/0269247 A1 12/2005 Sparks et al.
2005/0279672 A1 12/2005 Varadaraj et al.
2005/0279673 A1 12/2005 Eppig et al.
2005/0284798 A1 12/2005 Eppig et al.
2006/0006101 A1* 1/2006 Eppig et al. ..... 208/131
2006/0016727 A1 1/2006 Varadaraj
2006/0021907 A1 2/2006 Varadaraj et al.
2006/0183950 A1 8/2006 Varadaraj et al.
2006/0231462 A1 10/2006 Johnson
2007/0090020 A1 4/2007 Buchanan et al.
2008/0116109 A1 5/2008 McCoy et al.

FOREIGN PATENT DOCUMENTS

EP 0031697 A2 12/1980
EP 0160142 11/1985
EP 0254359 B1 1/1988
EP 0175511 B1 6/1988
EP 0146298 B1 5/1991
EP 0489573 B1 9/1995
GB 1218117 4/1968
GB 1266180 12/1969
GB 2268186 1/1994
JP 54013509 7/1977
JP 2000288371 4/1999
JP 2001038159 8/1999
KR 2002007235 1/2002
WO WO 95/14069 5/1995
WO WO 99/64540 12/1999
WO WO 00/06526 2/2000
WO WO 01/60771 A1 8/2001
WO WO 02/50212 A2 6/2002
WO WO 03/026781 A1 4/2003
WO WO 03/042330 A1 5/2003
WO WO 03/048271 A1 6/2003
WO WO 2004/018067 A2 3/2004
WO WO 2004/038316 A2 5/2004
WO WO 2004/104139 A1 12/2004
WO WO 2006/040328 A1 4/2006

OTHER PUBLICATIONS

V. S. Ravi-Kumar, Theodore T. Tsotsis, Muhammad Sahimi; "Studies of Transport of Asphaltenes through Membranes Using Hindered Diffusion Theories for Spheres and Spheroids," Ind. Eng. Chem. Res. 1997, 36, pp. 3154-3162.

Anna Duong, Goutam Chattopadhyaya, Wellington Y. Kwok, Kevin J. Smith; "An experimental study of heavy oil ultrafiltration using ceramic membranes," Fuel, vol. 76, No. 9, pp. 821-828, 1997.

B. D. Sparks, J. D. Hazlett, O. Kutowy, T. A. Tweddle; "Upgrading of Solvent Extracted Athabasca Bitumen by Membrane Ultrafiltration," AIChe Journal, Aug. 1990, vol. 36, No. 8, pp. 1279-1282.

Bruce Bishop, Robert Goldsmith, Robert Schucker, Keith Rawlins; "Ceramic Membrane Process for Upgrading Vacuum Residual Oil," Presentation at AIChE 2004 Spring Annual Meeting, New Orleans, LA, Apr. 25-29, 89d.

W. C. Lai, K. J. Smith; "Heavy oil microfiltration using ceramic monolith membranes," Fuel 80 (2001) pp. 1121-1130.

J. D. Hazlett, O. Kutowy, T. A. Tweddle, B. A. Farnand; "Processing of crude oils with polymeric ultrafiltration membranes," AIChE 1989 Spring National Meeting (Houston Apr. 2-6, 1989) AIChE Symposium Series V85 N. 272, 101-107 (1989).

Deqing Shi, Hongwei Yu, Jinrong Yang, Zhihau Zhang,Ying Kong; "Study on the separation performance of polyimide nanofiltration membrane for solvent recovery in the butanone-toluene dewaxing process of lube oil," Mo Kexue Yu Jishu (2005), 25(3), 50-53, 62. Abstract.

Zhi-Ping Zhao, Jiding Li, Jian Chen, Cui-Xian Chem; "Nanofiltration membrane prepared from polyacrylonitrile ultrafiltration membrane by low-temperature plasma," Journal of Membrane Science (2005), 251(1-2), 239-245. Abstract.

F. Petrus Cuperus, Katrin Ebert; "Non-aqueous application of NF," Nanofiltration (2005), 521-536, Editor(s): Schafer, A.I.; Fane, A.G.; Waite, Thomas D., Publisher: Elsevier Ltd., Oxford, UK. Abstract.

B. Bishop, R. Goldsmith, R. Schucker, K. Rawlins; "Ceramic membrane process for upgrading vacuum residual oil," 2004 AIChE Spring Meeting, Conference Proceedings, New Orleans, LA, 7p (2004) Abstract.

M. V. Veazey; "Tech trends: Microfiltration system," Materials Performance 43/5 15 (May 2004), Abstract.

T. Melin, M. Gallenkemper, J. Hoppe, C. Matthias, "Achema reports . Membrane engineering," Chemie-Ingenieur-Technik (Achema 2003 27(sup) t(sup) h International Exhibition-Congress on Chemical Engineering, 76/12 1869-1876, Dec. 2003., Abstract.

V. I. Il'in, V. A. Kolesnikov, A. V. D'Yachenko; "Electrically insulating petroleum oils and their refining," Oboronnyi Kompleks—Nauchno-Tekhnicheskomu Progressu Rossii (2002), (4), 69-71. Abstract.

A. P. Aleksandrin, A. A. Egorshev, O. V. Katsereva, E. A. Komyagin, V. N. Mynin, G. V. Terpugov; "Use of ceramic membranes for treatment end regeneration of depleted petroleum products," Tyazh. Mashinostr. -/6 30-32 (2002) Chemical Abstracts 138/5-6 Abstr. No. 58512 (2003). Abstract.

"Process industries exposition: Membrane rejects emulsified oils while maintaining hydrophilic properties," Chemical Engineering Progress 97/4 26 (Apr. 2001). Abstract.

K. J. Smith, W. C. Lai; "Heavy oil microfiltration using ceramic monolith membranes," Fuel, 80/8, 1121-1130 (Jun. 2001). Abstract.

R. M. Gould, L. S. White, C. R. Wildemuth; "Membrane separation in solvent lube dewaxing," Environmental Progress, 20/1, 12-16 (Apr. 2001). Abstract.

N. A. Bhore, R. M. Gould, S. M. Jacob, P. O. Staffeld, D. McNally, P. H. Smiley, C. R. Wildemuth; "New membrane process debottlenecks solvent dewaxing unit," Oil and Gas Journal, 97/46, 67-68, 70, 72-24 (1999 1115). Abstract.

Jiao-Li Li, Xu-Xiang Li, Bing-Hua Ni; "Development of ultrafiltration and its application in recovery of dewaxing solvent," Shihua Jishu Yu Yingyong (2000), 18(5), 295-297, 301. Abstract.

S. Elmaleh, N. Ghaffor; "Upgrading oil refinery effluents by cross-flow ultrafiltration," Water Science & Technology, 34(9), 231-238 (1996), Aqualine Abstracts Abstr. No. 97-4463 V13 N.9 (Sep. 1997). Abstract.

B. Park, V. S. Ravi-Kumar, T. T. Tsotsis; "Models and simulation of liquid—phase membrane reactors," Industrial & Engineering Chemistry Research, V37 N. 4, 1276-89 (Apr. 1998). Abstract.

A. Duong, K. J. Smith; "A model of ceramic membrane fouling during heavy oil," Canadian Journal of Chemical Engineering, V75 N. 6, 1122-29 (Dec. 1997). Abstract.

M. Garcia Sanchez, J. L. Perez Pavon, B. Moreno Cordero; J. Chromatogr., A, 766 (1+2), 61-69 (1997) Chemical Abstracts Abstr. No. 319181 V126 N. 24. Abstract.

V. S. Ravi-Kumar, T. T. Tsotsis, M. Sahimi; "Studies of the transport of asphaltenes through membranes using hindered diffusion theories for spheres and spheroids," Industrial & Engineering Chemistry Research, V36 N. 8, 3154-62 (Aug. 1997). Abstract.

V. S. Ravi-Kumar, L. Yang, T. T. Tsotsis; "Liquid-phase reactive applications with inorganic membranes : Models and experiments," ACS 214$^{th}$ National Meeting (Las Vegas Sep. 7-11, 1997) Book of Abstracts Part 2 Abstr. No. PMSE-273 (1997). Abstract.

A. Duong, G. Chattopadhyaya, W. Y. Kwok, K. J. Smith; "An experimental study [using Cold Lake (Alberta) oil] of heavy oil ultrafiltration using [single-tube] ceramic membranes," Fuel, V76, N. 9, 821-28 (Jul. 1997). Abstract.

S. Elmaleh, N. Ghaffor; "Upgrading oil refinery effluents by cross-flow ultrafiltration," Water Sci. Technol., 34(9), Water Quality International '96 Part (2), 231-238 (1996) Chemical Abstracts Abstr. No. 79315, V126 N. 6. Abstract.

E. Beaver, Siegel; Technologies critical to a changing world / Clean technologies), AIChE et al. 5$^{th}$ World Chemical Engineering Congress (San Diego Jul. 14-18, 1996) Summary Proceedings 100-03, 159-61 (Oct. 1996). Abstract.

W. Ying, B. Tansel; "Effect of coagulation on fouling rate and cleanability of ultrafiltration membranes," Purdue University 50$^{th}$ Industrial Waste Conference (West Lafayette, IN May 8-10, 1996) Proceedings 285-95 (1995). Abstract.

J. L. Humphrey; "Separation processes: Playing a critical role," Chemical Engineering Progress, V91, N. 10, 31-41 (Oct. 1995). Abstract.

V. N. Zrelov, N. G. Postnikova, L. V. Krasnaya; "Rapid membrane (diffusion) methods for determining mechanical impurities in liquid petroleum products," Khimiya I Tekhnologiya Topliv i Masel, N. 4, 28-30 (1994). Abstract.

B. D. Sparks, J. D. Hazlett, O. Kutowy, T. A. Tweddle, Union Carbide Corp.; "Upgrading of solvent extracted Athabasca bitumen by membrane ultrafiltration," AIChE Journal V36, N. 8, 1279-82 (Aug. 1990). Abstract.

R. J. Torres-Ordonez, S. G. Kukes, F. S. Lee, D. C. Cronauer; "Characterization of solids from coal/resid(ue) coprocessing," ACS 200$^{th}$ National Meeting (Washington, DC Aug. 26-31, 1990) ACS Division of Fuel Chemistry Preprints V35 N.4, 1048-55 (1990). Abstract.

B. D. Sparks, J. D. Hazlett, O. Kutowy, T. A. Tweddle; "Upgrading of solvent extracted Athabasca bitumen by Membrane ultrafiltration," AIChE 1987 Summer Natl. Meet. (Minneapolis 816-19/87 Prepr. N. 7D 22P. Abstract.

M. Nishimura; "Application and development of membrane separation processes in oil chemistry and its related fields," Yakagaku, 34(3), 171-7 (1985), Chem. Abstr. Abstr. No. 168846 V102 N. 20. Abstract.

D. S. Schuster, C. A. Irani; "Understanding the pour point depression mechanism—2, microfiltration analysis of crude oils," 189$^{th}$ ACS Natl. Meet. (Miami Beach Apr. 28-May 3, 1985) ACS Div. Fuel Chem. Prepr. V30 N.1, 169-77 (1985). Abstract.

J. Durandet; "Separation (Processes) in the refining industry/introduction separations dans le raffinage/introduction," Pet. Tech. N.298 5-6 (May 1983). Abstract.

J. Briant, G. Hotier; "The state of asphaltenes in hydrocarbon mixtures the size of molecular clusters," Rev. Inst. Fr. Pet. V38 N.1 83-100 (Jan.-Feb. 1983). Abstract.

D. Defives, R. Avrillon, C. Miniscloux, R. Roullet, X. Marze; "Regeneration of used lubricating oils by ultrafiltration," Informations Chimie (1978), 175, 127-31. Abstract.

A. Duong, K. Smith, JCS University of British Columbia; Canadian Journal of Chemical Engineering V75 N. 6, 1122-29 (Dec. 1997). Abstract.

V. N. Zrelov, N. G. Postnikova, L. V. Krasnaya; "Analytical filtration of petroleum and synthetic products through membranes," Khim. Tekhnol. Topl. Masel (1984), (11), 32-4. Abstract.

R. J. Thrash, R. H. Pildes; "The diffusion of Petroleum asphaltenes (from a Middle East high-sulfur vacuum residuum) through well characterized (MICA) porous membranes," 181$^{st}$ ACS Natl. Meet (Atlanta Mar. 29-Apr. 3, 1981) ACT Div. Pet. Chem. Prepr. V26 N.2515-25 (Mar. 1981). Abstract.

D. D. Spatz; "Ultrafiltration . . . The membranes, the process, and its application to organic molecule fractionation (Including industrial oil/water separations," 178$^{th}$ ACS Natl. Meet. (Washington, DC Sep. 9-14, 1979) Abstr. Pap. Abstr No. COLL-125. Abstract.

G. Sartori, W. S. Ho, R. E. Noone, B. H. Ballinger; "(New) poly(fluoroolefin) membranes for aromatics/saturates separation," AIChE 1997 Annual Meeting (Los Angeles Nov. 16-21, 1997) Preprint N.32d 6P. Abstract.

V. S. Ravi-Kumar, I. A. Webster, T. T. Tsotsis, R. C. Sane, M. Sahimi; "Studies of diffusion of petroleum liquid macromolecules through model membranes," AIChE 1992 Annual Meeting (Miami Beach Nov. 1-5, 1992) Preprint N.22g 3P. Abstract.
R. C. Sane, I. A. Webster, T. T. Tsotsis, V. S. Ravi-Kumar; "Studies of asphaltene diffusion and structure and their implications for resid(uum) upgrading," 12$^{th}$ International "Chemical Reaction Engineering Today" Symposium (Turin, Italy Jun. 28-Jul. 1, 1992) Chemical Engineering Science V47 N.9-11 2683-88 (Jun.-Aug. 1992). Abstract.
R. C. Sane; "The diffusion of petroleum asphaltenes in porous membranes," University of Southern California, Dissertation (1991) (Abstract) Dissertation Abstracts International: Section B Science & Engineering V52 N.8 4350-B (Feb. 1992). Abstract.
Yong Woo Rho, Hwayong Kim, Won Hee Park; "Effect of oil viscosity on ultrafiltration flux," Hwahak Konghak (1989), 27(4), 446-50. Abstract.
Yujun Song, Fuan Liu, Yong Yang, Jian Zou, Benhui Sun, Tianyuan Zhong; "Review on the preparation and application of nanofiltration membrane," Huagong Keji (1999), 7(3), 1-7. Abstract.
May-Britt Haag; "Membranes in chemical processing. A review of applications and novel developments," Separation and Purification Methods (1998), 27(1), 51-168. Abstract.
H. Zuern, K. Kohlhase,K. Hedden, J. Weitkamp; "Developments in refinery technology—1. Process technology, processing of crudes, residua, and heavy oils," 50$^{th}$ DGMK Anniv. Meet (Berline Nov. 24-26, 1983) Erdoel Kohle, Erdgas, Petrochem. Brennst. Chem. V37 N.2 52-69 (Feb. 1984). Abstract.
R. E. Baltus, J. L. Anderson; "Hindered diffusion of asphaltenes through microporous membranres," Chemical Engineering Science (1983), 38(12) 1959-69. Abstract.
A. Duong, K. J. Smith; "A model of ceramic membrane fouling during heavy oil utlrafiltration," Canadian Journal of Chemical Engineering V75 N.6 1122-29 (Dec. 1997). Abstract.
Gentzis, Thomas; Rahimi, Pavid; Malhotra, Ripudaman; Hirschon, Albert S.; "The effect of carbon additives on the mesophase induction period of Athabasca bitumen," Fuel Processing Technology 69 (2001) pp. 191-203.
Dabkowski, M. J.; Shih, S.S.; Albinson, K.R.; "Upgrading of petroleum residue with dispersed additives," Mobil Research & Development Corporation, Paulsboro, NJ. Presented as Paper 19E at the 1990 AIChE National Meeting.
Giavarini, C.; Mastrofini, D; Scarsella, M.; "Macrostructure and Rheological Properties of Chemically Modified Residues and Bitumens," Energy & Fuels 2000, 14, pp. 495-502.
Lakatos-Szabo, J; Lakatos, I.; "Effect of sodium hydroxide on interfacial rheological properties of oil-water systems," Research Institute of Applied Chemistry, University of Miskolc, Hungary, accepted Aug. 24, 1998, Elsevier Science B.V.., Physicochemical and Engineering Aspects 149 (1999) pp. 507-513.
Ellis, Paul J.; Paul, Christopher A.; "Tutorial: Delayed Coking Fundamentals," Great Lakes Carbon Corporation, Port Arthur, TX, copyright 1998 (unpublished). Presented at the AIChE 198 Spring National Meeting, New Orleans, LA, Mar. 8-12, 1998.
J. D. Hazlett; O. Kutowy; T. A. Tweedle; B. A. Farnand; "Processing of crude oils with polymeric ultrafiltration membranes"; National Research Council Can., 1989 AIChE Spring Nat'l Meeting (Houston Apr. 2-6, 1989) Prepr. N. 64f 18P.

* cited by examiner

Coke Produced from Sample 1 Retentate

Coke Produced from Sample 1 Resid

Coke Produced from Sample 2 Retentate

Coke Produced from Sample 2 Resid

Coke Produced from Sample 3 Retentate

Coke Produced from Sample 3 Resid

Coke Produced from Sample 4 Retentate

Coke Produced from Sample 4 Resid

Coke Produced from Sample 5 Retentate

Coke Produced from Sample 5 Resid

Coke Produced from Sample 6 Retentate

Coke Produced from Sample 6 Resid

Coke Produced from Sample 7 Retentate

Coke Produced from Sample 7 Resid

PRODUCTION OF AN ENHANCED RESID COKER FEED USING ULTRAFILTRATION

This Application claims the benefit of U.S. Provisional Application No. 60/966,518 filed Aug. 28, 2007.

FIELD OF THE INVENTION

This invention relates to a combined high-pressure ultrafiltration and delayed coking process for producing a free-flowing coke, preferably a free-flowing shot coke from an atmospheric and/or vacuum resid feedstock.

DESCRIPTION OF RELATED ART

Delayed coking involves thermal decomposition of heavy hydrocarbon, residual feedstocks including petroleum residua (resids) and deasphalter bottoms etc. to produce gas, liquid streams of various boiling ranges, and coke. Delayed coking of these residual feedstocks produced as intermediate refining product streams from heavy and heavy sour (high sulfur) crude oils is carried out primarily as a means of disposing of these low value feedstocks by converting part of the residual feedstocks to more valuable liquid and gas products.

In the delayed coking process, a resid feedstock is rapidly heated in a fired heater or tubular furnace at from about 896° F. to about 968° F. (480° C. to 520° C.) and pressures of about 50 to 550 psig. The heated feedstock is then passed to a coking drum that is maintained at conditions under which coking occurs, generally at temperatures of about 800° F. (427° C.), typically between about 750° F. to about 925° F. (399° C. to 496° C.), under super-atmospheric pressures of about 15 to 80 psig to allow volatiles that form in the coker drum to be removed overhead and passed to a fractionator, leaving coke behind. When the coker drum is full of coke, the heated feed is switched to another drum and additional hydrocarbon vapors are purged from the coke drum with steam. The drum is then quenched with water to lower the temperature to below about 300° F. (149° C.) after which the water is drained. When the cooling step is complete, the drum is opened and the coke is removed after drilling and/or cutting using high velocity water jets.

For example, a high speed, high impact water jet is used to cut the coke from the drum. A hole is typically bored in the coke from water jet nozzles located on a boring tool. Nozzles oriented horizontally on the head of a cutting tool then cut the coke from the drum. The coke removal step adds considerably to the throughput time of the overall process. Thus, it would be desirable to be able to produce a free-flowing coke, in a coker drum, that would not require the expense and time associated with conventional coke removal, i.e., it could be free-flowed from the bottom of the drum without the need of a separate coke cutting step.

Additionally, even though the coking drum may appear to be completely cooled, some volumes of the bed may have been bypassed by the cooling water, leaving the bypassed coke very hot (hotter than the boiling point of water). This phenomenon, sometimes referred to as "hot spots" or "hot drums", may be the result of a combination of morphologies of coke being present in the drum, which may contain a combination of more than one type of solid coke product, i.e., sponge coke and shot coke. These hot spots can produce dangerous problems with coke blowouts during coke cutting operations as well as possible coke fires due to the hot coke igniting when exposed to an oxygen-rich atmosphere. Since unagglomerated shot coke may cool faster than other coke morphologies, such as large shot coke masses or sponge coke, it would be desirable to predominantly produce free-flowing shot coke in a delayed coker, in order to avoid or minimize hot drums.

Additionally, these heavy hydrocarbon residual feedstocks may be further processed in a fluidized coking process or fluid coking process instead of a delayed coking process as described above. In a fluidized coking process, the resid feedstock is converted to lighter, more valuable products by thermal decomposing the feedstream at elevated reaction temperatures, typically from about 900° F. to about 1100° F. (480° C. to 590° C.). The rate of introduction of the feed into a fluid coker is limited by the rate at which it can be converted to dry coke. The major reactions that produce coke involve the cracking of aliphatic side chains from aromatic cores, de-methylation of aromatic cores and aromatization.

However, the reaction rate of de-methylation of aromatic cores is significantly slower than the rate of cracking of aliphatic side chains and results in the buildup of a sticky layer of coke particles that limits the efficiency of the operation of the fluid coker. These sticky coke particles can cause excessive fouling in the fluid coking reactor, particularly in the stripper shed zone area of the reactor wherein these sticky coke particles tend to agglomerate and contact a stick to the shed trays causing fouling. This fouling results in a loss of flow efficiency due to plugging as well as a loss in separation efficiency of the lighter hydrocarbons from the coke particles. A dry (largely demethylated) coke that has lower hydrogen to carbon ratio ("H/C" ratio) provides the potential for increased throughput, higher liquid yields, better liquid quality, less gas make, and reduced fouling of the reactor. Therefore, it would be desirable to produce a resid feedstream for use as a fluid coker feedstock that has a lower H/C ratio.

SUMMARY OF THE INVENTION

In one embodiment, the process of the present invention involves utilizing a high-pressure ultrafiltration process to produce an improved coker feed for producing a free-flowing coke, preferably a free-flowing shot coke from an atmospheric and/or vacuum resid feedstock. In another preferred embodiment, the process of this invention utilizes a high-pressure ultrafiltration process to produce an enhanced coker feedstream with improved the Conradson Carbon Residue ("CCR") content which is utilized in either an improved delayed coking or a fluid coking process.

In a preferred embodiment, the present invention is a process to produce a free-flowing shot coke, comprising:

a) conducting a resid feedstream to a retentate zone of a membrane separations unit wherein the resid feedstream contacts a first side of at least one permeable membrane;

b) passing a portion of the resid feedstream from the first side of the membrane, through the membrane, to a second side of the membrane;

c) retrieving a permeate product from the second side of the membrane;

d) retrieving a retentate product stream from the first side of the membrane, wherein the CCR wt % content of the retentate product is greater than the CCR wt % content of the resid feedstream;

e) conducting at least a portion of the retentate product to a delayed coking unit; and f) obtaining a substantially free-flowing coke product from the delayed coking unit.

This invention can allow the cycle time of a delayed coker unit to be significantly reduced, allowing for an increase in throughput for refinery units wherein the delayed coker unit is a bottleneck. The present invention allows for significantly decreased cycle times and increased volumetric throughput to a delayed coker unit while operating the coker unit in either a batch cycle mode, a semi-continuous cycle mode, or a continuous mode.

In another preferred embodiment, the present invention is a process for producing an advanced enhanced coker feedstream from a resid feedstream, comprising:

a) conducting the resid feedstream to the retentate zone of a membrane separations unit wherein the resid feedstream contacts a first side of at least one permeable membrane;

b) passing a portion of the resid feedstream from the first side of the membrane, through the membrane, to a second side of the membrane;

c) retrieving a permeate product from the second side of the membrane;

d) retrieving a retentate product stream from the first side of the membrane, wherein the CCR wt % content of the retentate product is greater than the CCR wt % content of the resid feedstream; and e) conducting at least a portion of the retentate product to a coker unit.

Preferably, the retentate product thus obtained is further processed in a Fluid Coking or Flexicoking unit. The retentate product produced by the present invention has an increased CCR content with a lower hydrogen to carbon atomic ratio ("H/C" ratio) which provides the potential for increased throughput, higher liquid yields, better liquid quality, less gas make, as well as reduced fouling of the fluid coking reactor.

DETAILED DESCRIPTION OF THE INVENTION

Figure 1:
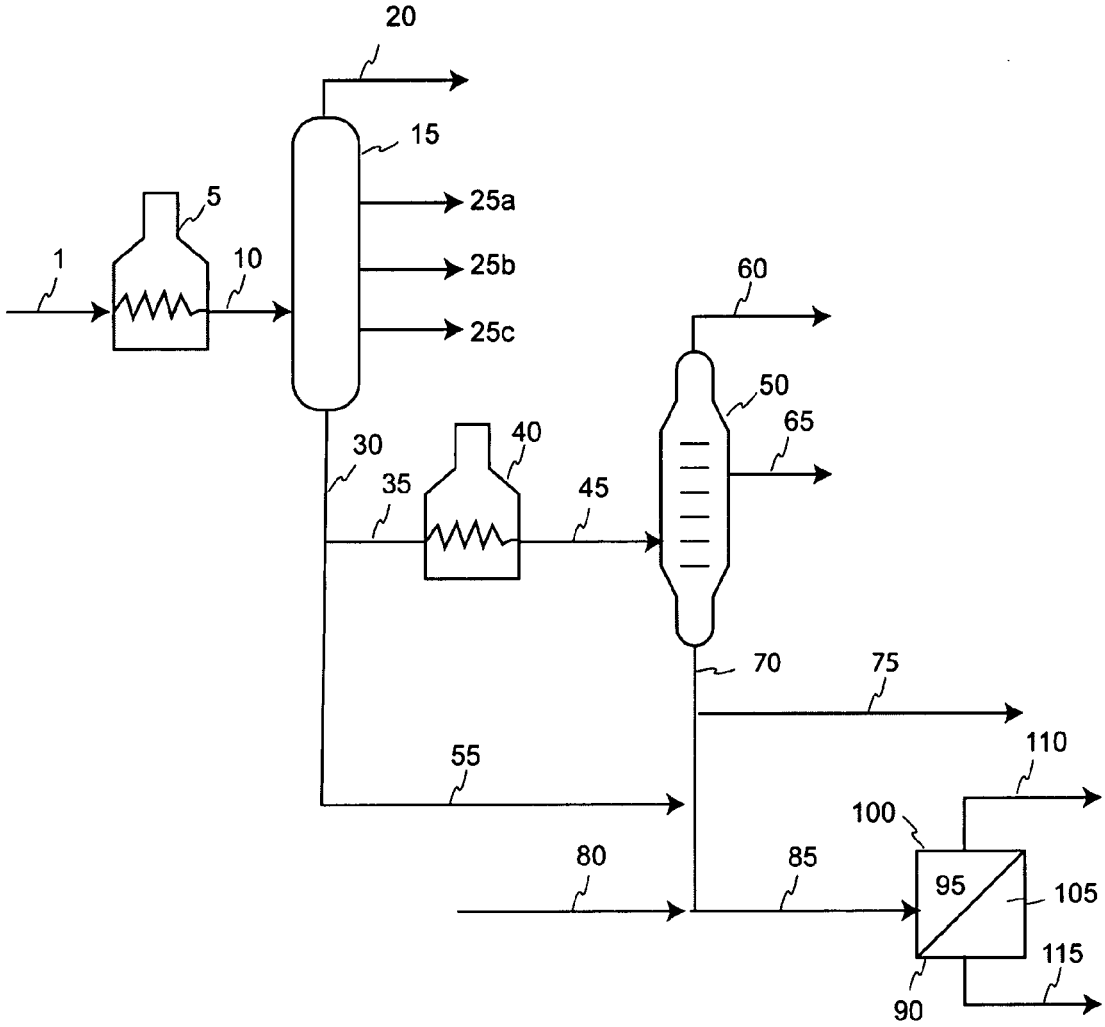
FIG. 1 is a simplified process flow diagram of a preferred embodiment wherein a vacuum resid containing feedstream is subjected to a high-pressure ultrafiltration process and the retentate obtained from the ultrafiltration process is utilized as a feedstock to a delayed coking process to produce a free-flowing coke product.

Petroleum atmospheric and vacuum residua ("resid") feedstocks are suitable for delayed coking. Such petroleum residua are frequently obtained after removal of distillates from crude feedstocks under near atmospheric pressure to near full vacuum pressure conditions and are characterized as being comprised of components of large molecular size and weight, generally containing: (a) asphaltenes and other high molecular weight aromatic and heteroaromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating and hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking and hydrotreating catalysts.

There are generally four different morphology types of solid delayed coker products that have different values, appearances and properties, i.e., needle coke, sponge coke, transition coke and shot coke. These coke morphologies are well-known by those of skill in the art. A general description of the characteristics of each these coke morphologies is provided herein.

Needle coke is the highest quality of the three varieties. Needle coke, upon further thermal treatment, has high electrical conductivity (and a low coefficient of thermal expansion) and is used as an anode in steel and aluminum production. It is relatively low in sulfur and metals and is frequently produced from some of the higher quality coker feedstocks that include more aromatic feedstocks such as slurry and decant oils from catalytic crackers and thermal cracking tars. Typically, needle coke is not formed by delayed coking of high sulfur resid feeds.

Sponge coke, as the name suggests, has a sponge-like appearance with various sized pores and bubbles "frozen into" a solid coke matrix. One key attribute of sponge coke produced by routine coker operating conditions is that the coke is self-supporting, and typically will not fall out of the bottom of an un-headed coker drum, which typically has a head diameter of about 6 feet. The head of the coker drum can be removed either manually or by use of a slide valve.

Shot coke is a distinctive type of coke. It is comprised of individual substantially spherical particles. These individual particles range from substantially spherical to slightly ellipsoidal with average diameters of about 1 mm to about 10 mm. The particles may be loose or aggregated into larger-sized particles, e.g., from tennis-ball size to basketball or larger sizes. The shot coke can sometimes migrate through the coke bed and to the bottom drain lines of the coke drum and slow, or even block, the quench water drain process. While shot coke has a lower economic value than sponge coke, it is the desired product coke for purposes of this invention because its ease of removal from the coker drum results in effectively increasing the process capacity which more than offsets its reduced economic valve.

At times there appears to be a binder material, e.g., a sponge coke binder, present between the individual shot coke particles, and such a coke is sometimes referred to as "bonded shot" coke. Depending upon the degree of bonding in the bed of shot coke, the bed may not be self-supporting, and can flow out of the drum when the drum is opened. This can be referred to as "fall-out" and if it occurs unexpectedly, it can be dangerous to operating personnel and also damage equipment.

The term "transition coke" refers to coke that has morphology between that of sponge coke and shot coke. For example, coke that has a mostly sponge-like physical appearance, but with evidence of small shot spheres that are just beginning to form as discrete particles in one type of transition coke.

Coke beds are not necessarily comprised of all of one type of coke morphology. For example, the bottom of a coke drum can contain large aggregates of shot, transitioning into a section of loose shot coke, and finally have a layer of sponge-rich coke at the top of the bed of coke.

The term "free-flowing" as used herein means that about 500 tons of coke plus its interstitial water in a coker drum can be drained in less than about 30 minutes through a 60-inch diameter opening without the required use of water cutting to remove the initial coke from the coke drum. That is, that water cutting may be utilized to "clean up" the drum after initial coke removal, but is not required to remove the majority (i.e., 95 vol %+) of the "free-flowing" coke from the coker drum. It has been discovered that free-flowing shot coke can be produced by the practice of the present invention whereby a retentate product with an increased CCR content is produced from a vacuum resid containing feedstream for use as a coker feedstream or as a component in a coker feedstream to help force the morphology produced to a free-flowing coke or free-flowing shot coke.

In an embodiment, resid feedstocks include but are not limited to residues from the atmospheric and vacuum distillation of petroleum crudes or the atmospheric or vacuum distillation of heavy oils, visbroken resids, tars from deasphalting units, coal liquids, shale oil or combinations of these materials. Whole bitumens or atmospheric or vacuum topped heavy bitumens can also be employed. Feedstocks typically used in delayed coking are high-boiling hydrocarbon-containing process streams with an API gravity of about 20° or less, and a Conradson Carbon Residue content of about 0 to 40 weight percent.

Vacuum resids are characterized by a number of parameters, including their boiling point distributions. The boiling point distribution can be obtained by a physical distillation in a laboratory, but it is costly to perform this type of analysis. Another method for determining the boiling point distribution is to use specialized gas chromatographic techniques that have been developed for the petroleum industry. One such GC method is High-temperature Simulated Distillation (HTSD). This method is described by D. C. Villalanti, et al. In "High-temperature Simulated Distillation Applications in Petroleum Characterization" in Encyclopedia of Analytical Chemistry, R. A. Meyers (Ed.), pp. 6726-6741 John Wiley, 2000, and has been found to be effective for characterizing the boiling point distributions of vacuum residua. Boiling point distributions are reported as wt % off versus atmospheric equivalent boiling point (AEBP) and are report in increments of 1 wt %.

Both atmospheric and vacuum distillation is well known in the industry. Normally, most of, but not necessarily all, of the bottoms fraction obtained from the atmospheric distillation column is heated and sent to a vacuum distillation column for further processing. The vacuum distillation column is operated between a partial vacuum and a near full vacuum overhead pressure. This allows additional fractions of heavy oil products to be distilled due to the lower boiling temperatures of these components under vacuum. Heating the atmospheric tower to a temperature sufficient to boil off these fraction that may be obtained under vacuum conditions would result in significant coke formation due to excessive thermal cracking of the hydrocarbon molecules that comprise the atmospheric bottoms stream.

The higher molecular weight hydrocarbons, including asphaltenes, as well as metals and other contaminants, such as sulfur, tend to accumulate in these bottoms products. As such, both the atmospheric tower bottoms, and to an even greater extent, the vacuum tower bottoms contain a significant percentage of the asphaltenes, metals and sulfur that are present in the crude feed originally processed. Unfortunately, there is also a significant amount of valuable hydrocarbon species that are tied up in these bottoms product. These valuable hydrocarbon components cannot be significantly further separated from the asphaltenes and contaminants by conventional processing such as distillation. These valuable components in the resid streams are therefore thermally cracked resulting in a low recovery of these valuable components due to the relatively low selectivity achieved in the thermally cracked products. On the other hand, the vacuum bottoms stream contains a significant amount of the asphaltenes and contaminants as well which precludes these streams from being processed in conventional hydrotreating or catalytic cracking units. As a result, the vacuum bottoms stream containing a mixture of asphaltenes, metals, sulfur as well as valuable hydrocarbon components is typically sent to a thermal cracking unit such as a delayed coker unit or a fluid coking unit.

It has been discovered that by decreasing the Hydrogen to Carbon atomic ratio ("H/C ratio") in the feedstream to a delayed coker unit, the coke formed in the coking process changes from a sponge coke to a shot coke. This shot coke can then be removed from the coke drums in a "fluidized" manner without the need for water cutting in either a continuous coking or semi-continuous coking process. Since the throughput capacity of a coking unit is most often limited by the overall cycle time of the coking cycle, depending on the circumstances, the elimination of the water cutting step can increase the drum capacity of a coking unit anywhere from about 20% to as much as about 50% resulting in significant additional unit throughput while utilizing existing hardware.

Additionally, decreasing the Hydrogen to Carbon atomic ratio ("H/C ratio") in the feedstream to a fluid coking unit can also have significant benefits. It should be noted that the Conradson Carbon Residue (CCR) test as utilized herein is a measurement of the carbon content of a fixed amount of hydrocarbon sample and thus is a good indicator of the H/C ratio of a given hydrocarbon sample.

The current invention employs a separation process wherein a hydrocarbon resid feed is subjected to a membrane high transmembrane pressure separation process to separate the resid feedstream into a high Conradson Carbon Residue ("CCR") content stream which can then be sent to a either a delayed coker unit, a Fluid Coking unit, or a Flexicoking unit for further processing with improved processing results, improved unit throughput and/or improved valuable product recoveries.

FIG. 1 illustrates a preferred embodiment of the present invention. Here a crude feedstream (1) is heated in an atmospheric tower heater (5) to temperatures normally of about 650° F. to about 750° F. (343° C. to 400° C.). It should be noted that the crude feedstream generally undergoes some pre-treatment prior to this step such as filtering, desalting, and dewatering prior to being fed to the atmospheric heater (5). It should also be noted that besides utilizing a straight-run crude (i.e., a crude that has not been significantly pre-processed), the crude feedstream may be comprised of a partially distilled product obtained from a low API gravity crude, a coal liquification product, a product stream from bitumen processing, a shale oil or combinations thereof.

The atmospheric heater outlet stream (10) is then sent to an atmospheric distillation column (15) wherein the hydrocarbons are distilled into several different cut streams. Typically, the overhead stream (20) is comprised of light petroleum gases in the $C_1$ to $C_5$ range. Several intermediate streams may be taken from the atmospheric distillation column and is dependent upon the intermediate products wished to be obtained. These streams are shown collectively as streams (25*a*), (25*b*), and (25*c*) in FIG. 1 for illustrative purposes only, but these streams are commonly comprised of light straight run (LSR) gasolines, naphthas, distillates, and gas oils. The heavier components which do not boil off in the atmospheric tower are recovered as atmospheric tower bottoms stream (30). In a typical refinery, most, if not all, of the atmospheric tower bottoms stream (30) is routed via line (35) to the vacuum heater (40) where it is heated to temperatures of normally about 700° F. to about 850° F. (371° C. to 455° C.) to produce a vacuum heater outlet stream (45) which is fed to the vacuum distillation column (50) for separation of components by boiling range. However, in the current invention, a portion of the atmospheric bottoms stream can be sent to the membrane separations zone via line (55).

In the vacuum distillation column (50), the feedstream is separated by distillation into several boiling ranges streams. The vacuum distillation column is preferably run at an overhead vacuum pressure from about 0 to about 7.5 psia, more preferably from about 0.5 to about 3 psia. For simplification purposes, only an overhead vacuum product stream (60), an intermediate vacuum product stream (65), and a vacuum tower bottoms stream (70) are shown in FIG. 1. Additional product streams may be drawn from the vacuum distillation column if desired. The overhead vacuum product stream (60) is typically pulled of with vacuum eductors and is comprised of light petroleum gas, as well as gasoline and naphtha range material. The intermediate vacuum product stream (65) is typically comprised of gas oil range materials with boiling points from about 700° F. to about 1050° F. (371° C. to 566° C.).

The vacuum tower bottoms (VTB) stream (70) contains hydrocarbons typically boiling in the range of about 850° F.+ (455° F.+) (atmospheric pressure basis). Additionally, the vacuum tower bottoms stream (70) contains most of the metals and a significant amount of the sulfur that was present in the crude feedstream (1) albeit at a much higher concentration due to the reduction of the overall feedstream. Sulfur contents of 3 to 5 wt % and greater are not uncommon in the vacuum tower bottoms streams produced from many high sulfur crude feeds. Additionally, the asphaltene content is very high in the vacuum tower bottoms streams. One indirect measurement of the asphaltene content of a hydrocarbon stream is by measuring the Conradson Carbon Residue ("CCR") or Micro Carbon Residue ("MCR") content of the hydrocarbon stream. It should be noted that the terms Conradson Carbon Residue ("CCR") or Micro Carbon Residue ("MCR") are considered herein as equivalents and the terms are used interchangeably herein. One standard test for measuring the MCR content of a stream is ASTM Method D-4530 "Standard Test for the Determination of Carbon Residue (Micro Method)".

Continuing with FIG. 1, in the current invention, at least a portion of the high asphaltene, high metal content vacuum tower bottoms streams is sent via lines 70 and 85 to a high pressure membrane separation unit (90). Some portion of the vacuum tower bottoms stream (70) may be sent for further processing such as, but not limited to, being sent directly to a thermal conversion unit. As shown in FIG. 1, in one embodiment, the vacuum tower bottoms stream (70), may alternatively be mixed with a portion of the atmospheric bottoms stream (55) or in another embodiment, the vacuum tower bottoms stream (70), may be mixed with a heavy component stream (80) comprised of a deasphalter bottom stream, a steam cracker tar stream, a visbreaker bottoms stream, a vacuum gas oil stream or a combination thereof. The combined membrane feedstream (85) is then sent to the membrane separation unit (90). In a preferred embodiment, the combined membrane feedstream (85) has a final boiling point of at least 1100° F. (593° C.). The term "final boiling point" as used herein is defined as the temperature at which 95 wt % of the mixture is volatized at atmospheric (standard) pressure.

It should be noted that for simplification purposes, auxiliary equipment such as pumps and heat exchangers are not shown in FIG. 1. However, the combined membrane feedstream (85) will be raised to a pressure of at least 300 psig, preferably at least 500 psi, more preferably at least 700 psi, and even more preferably at least 1000 psi prior to entering the membrane separations unit (90). This may be accomplished by a common pump prior to entry into the membrane separations unit (90), by separate pumps on the separate components streams, by a combination of pumps, or by any conventional means known in the art. Additionally, the combined membrane feedstream (85) may be heated prior to entering the membrane separations unit (90) by any conventional means known in the art to obtain an optimum feed temperature to the membrane separations process. Preferably, the combined membrane feedstream (85) will be at a temperature from about 212° F. to about 662° F. (100° C. to 350° C.), more preferably from about 302° F. to about 572° F. (150° C. to 300° C.) prior to entering the membrane separations unit (90).

The membrane separations unit (90) contains at least one ultrafiltration membrane that can withstand high transmembrane pressures as well as high feedstream temperatures. The transmembrane pressure is defined herein as the difference in pressure across the membrane element, in particular, the difference in pressure between the retentate (feedstream) side of the membrane element and the permeate side of the membrane element. In a preferred embodiment of the present invention, the transmembrane pressure is at least 300 psig, preferably at least 500 psi, more preferably at least 700 psi, and even more preferably at least 1000 psi.

The combined membrane feedstream (85) enters the membrane separations unit (90) which comprises at least one microporous membrane element (95) and comprises a retentate zone (100) wherein the membrane feedstream contacts a first high pressure side of a microporous permeable membrane, and a permeate zone (105) wherein a permeate product stream is obtained from the opposite or second side of the membrane and is comprised of selective materials that permeate through the membrane (95). The retentate product stream (110) is retrieved from the retentate zone (100) deplete of the extracted permeated components, and the permeate product stream (115) is retrieved from the permeate zone (105) for further processing. In one embodiment of the present invention, the retentate product stream (110), which has an increased CCR content is sent to a delayed coking unit wherein a free-flowing shot coke is produced. The delayed coker may be operated on a batch cycle, wherein a shot coke is produced in a coker drum, and following the coker quench cycle, the solid drum bottom head is then opened and the shot coke, or shot coke plus water, is allowed to free flow from the coker drum with little or no requirements for water cutting.

Alternatively, the coker unit may be operated in a semi-continuous cycle, wherein the drum has a defined feed cycle and quench cycle, and a valve is located at or near the coke drum bottom flange which allows the drum to be opened and the coke from the coke drum to be evacuated through the coke drum bottoms valve in a non-continuous manner. In yet another preferred cycle operation, the coke drum cycle is continuous. Since the present invention provides for the production of a shot coke that does not require a separate cutting cycle, the coke drum may be fitted with a coke drum bottoms slide valve located at or near the coke drum bottom flange which allows the coke produced by the delayed coking process to be removed from the drum by throttling the coke drum bottoms valve to control the rate at which the produced delayed coke is removed from the drum.

In a another embodiment of the present invention, the retentate product stream (110), which has an increased CCR content is sent to a fluid coking unit. As described above, the retentate produced in the process of the present invention provides an excellent feed for a fluid coking unit due to the low H/C ratio of the retentate product stream. The benefits of a coker feedstream possessing these improved characteristics has been discussed herein above.

An additional benefit of the current process is that the permeate product stream (115) thus obtained has improved hydrocarbon characteristics and a reduced asphaltenes and metals content. As discussed, many of the valuable, non-asphaltene hydrocarbons that are in the atmospheric and vacuum resid streams are lost due to being inseparable from the resids streams produced by conventional distillation. These valuable hydrocarbons are often destroyed in the thermal cracking processes such as delayed coking and fluid coking processes by overcracking to light, lower value products such as $C_5$ and lighter materials. The present invention can produce a permeate products stream that has a lower CCR content, lower asphaltene content, lower metals content, and a lower sulfur content. Due to the improved reduced molecular weight, reduced metal, and reduced sulfur properties, the permeate product stream thus produced can then be used as a feedstock to refinery catalytic upgrading process such as, but not limited to, fluid catalytic cracking, hydrocracking, hydrotreating, hydrodesulfurization, isomerization and/or hydroisomerization processes. Use in such processes would generally not be economically possible without removing a significant portion of the asphaltenes and contaminants that are removed in the process of the present invention.

It should also be noted that besides producing an improved coker feed via the retentate stream as well as an improved recovery of valuable hydrocarbons in the permeate stream produced, the process of the present invention can be used to increase production rates in refineries wherein either a delayed coker or fluidized coker is utilized. The removal of the improved permeate stream from the coker feed results in less volumetric flow to the coker, thereby improving overall refinery production rates. Therefore, in addition to the primary benefits of the improved coker feedstream in either reducing the overall delayed coker cycle time, or improving the throughput of a fluidized coker, the present invention can further improve a refinery's overall production rates. These two variables work independently of one another and are thus cumulative in determining the overall economic benefits of the present invention.

In a preferred embodiment of the present invention, at least one membrane has an average pore size of about 0.001 to about 2 microns (μm), more preferably about 0.002 to about 1 micron, and even more preferably about 0.004 to about 0.1 microns. It is also preferred that the membranes utilized in the present invention be constructed of such materials and designed so as to withstand prolonged operation at elevated temperatures and transmembrane pressures. In one embodiment of the present invention the membrane is comprised of a material selected from a ceramic, a metal, a glass, a polymer, or combinations thereof. In another embodiment, the membrane comprised of a material selected from a ceramic, a metal, or combination of ceramic and metal materials. Particular polymers that may be useful in embodiments of the present invention are polymers comprised of polyimides, polyamides, and/or polytetrafluoroethylene provided that the membrane material chosen is sufficiently stable at the operating temperature of the separations process.

In a preferred embodiment, the heavy hydrocarbon feedstream is flowed across the face of the membrane element(s) in a "cross-flow" configuration. In this embodiment, in the retentate zone, the heavy hydrocarbon feed contacts one end of the membrane element and flows across the membrane, while a retentate product stream is withdrawn from the other end of the retentate zone. As the feedstream/retentate flows across the face of the membrane, a composition selective in saturated compounds content flows through the membrane to the permeate zone wherein it is drawn off as a permeate product stream. In a cross-flow configuration, it is preferable that the Reynolds number in at least one retentate zone of the membrane separations unit be in the turbulent range, preferably above about 2000, and more preferably, above about 4000. In some embodiments, a portion of a retentate stream obtained from the membrane separation units may be recycled and mixed with the feedstream to the membrane separations unit prior to contacting the active membrane.

In the current invention, the Conradson Carbon Residue (CCR) content of the retentate of the membranes separation process is significantly increased with respect to the feedstream to the membrane separations process. As discussed previously, it has been discovered that a higher CCR wt % content of a coker feedstream comprised of a vacuum resid can improve the morphology of a delayed coker unit coke product to a shot coke. It can be seen in the Example and associated Table 1, that the process of the present invention can increase the CCR content of the retentate produced by a CCR Increase Factor of at least 1.2. This CCR Increase Factor is defined herein as the CCR wt % of the retentate product stream divided by the CCR wt % of the combined membrane feedstream entering the retentate zone of the membrane separations unit. Preferably, CCR Increase Factor is at least 1.5, more preferably, the CCR Increase Factor is at least 2.0.

FIGS. 2A through 8B show optical microscopy images of coked samples from the seven vacuum resid samples tested in the Example both without processing through the membrane separations unit of the present invention (i.e., representative of a sample stream sent directly to a delayed coker), shown as the "A" designated Figures; as well as images of coked samples of the retentate obtained from the membrane separations unit of the present invention, shown as the corresponding "B" designated Figures. Each of the Figures indicates the Vacuum Resid Sample number corresponding to the Sample numbers shown in Table 1.

As can be seen in each of the corresponding Figures for each Sample (i.e., Figure "A" and corresponding Figure "B" for each Sample), in each sample, the flow domains and the mosaic size of each of the corresponding coked retentate samples showed a visibly improved coke morphology for shot coke production.

The present invention will be better understood by reference to the following non-limiting examples that are presented below.

EXAMPLE

In this Example, seven samples of different vacuum resids were tested for CCR content, nickel content, vanadium content, and sulfur content. The results of the Feed Properties for each of these samples are presented in Table 1.

indicating an increase in CCR wt % content of the retentate samples from the testing of at least 40%. In some cases, the content was improved by about 100% (i.e., a CCR Increase Factor of at least 2.0).

Additionally, the nickel (Ni), vanadium (V) and sulfur (S) contents of the retentate were significantly increased as can be seen in Table 1. In preferred embodiments of the present invention, the Nickel Increase Factor is at least 1.5, preferably at least 2.0. Similarly, in a preferred embodiment, the Vanadium Increase Factor is at least 1.5, preferably at least 2.0. These Increase Factors are defined in a similar manner as the CCR Increase Factor herein.

Figure 2B:
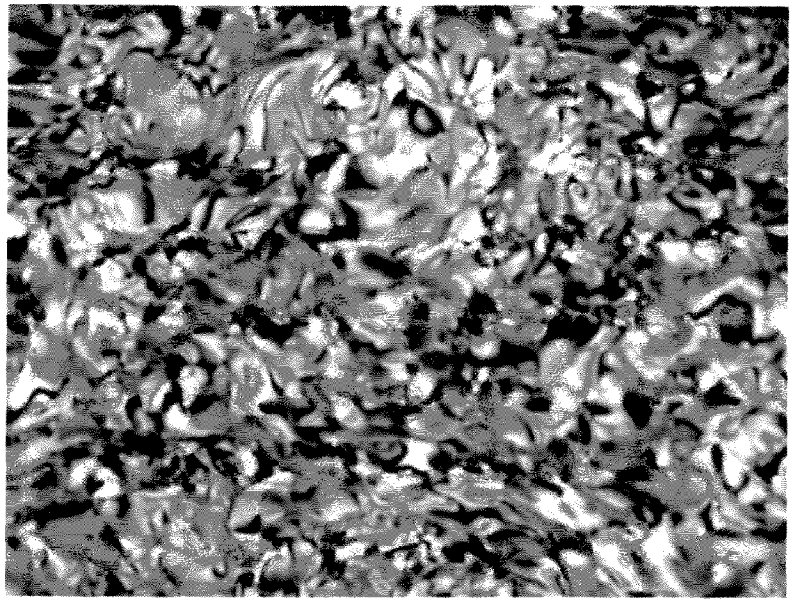
FIG. 2B is an optical microscopy image of coke produced from the retentate obtained from the ultrafiltration of the vacuum resid designated as Sample 1 in the Example. The image viewing area is 174×130 microns.
Figure 2A:
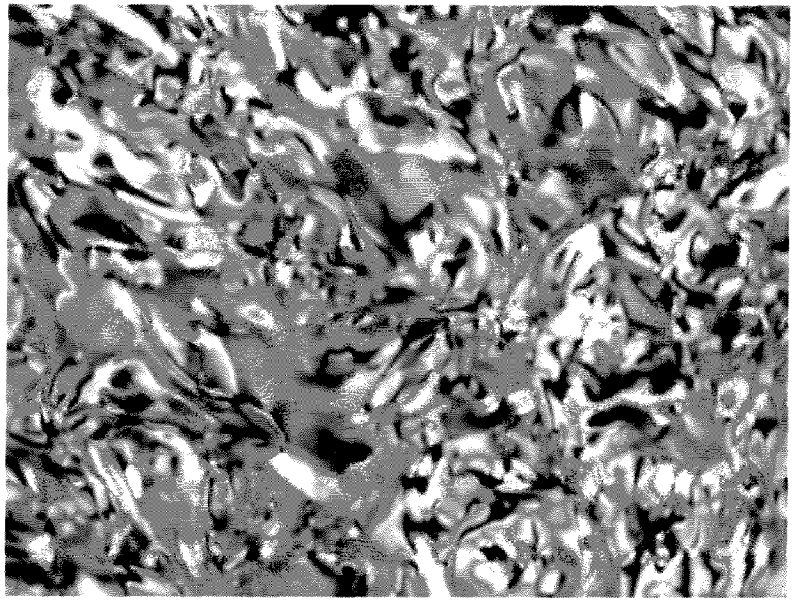
FIG. 2A is an optical microscopy image of coke produced from the vacuum resid designated as Sample 1 in the Example. The image viewing area is 174×130 microns.
Figure 3B:
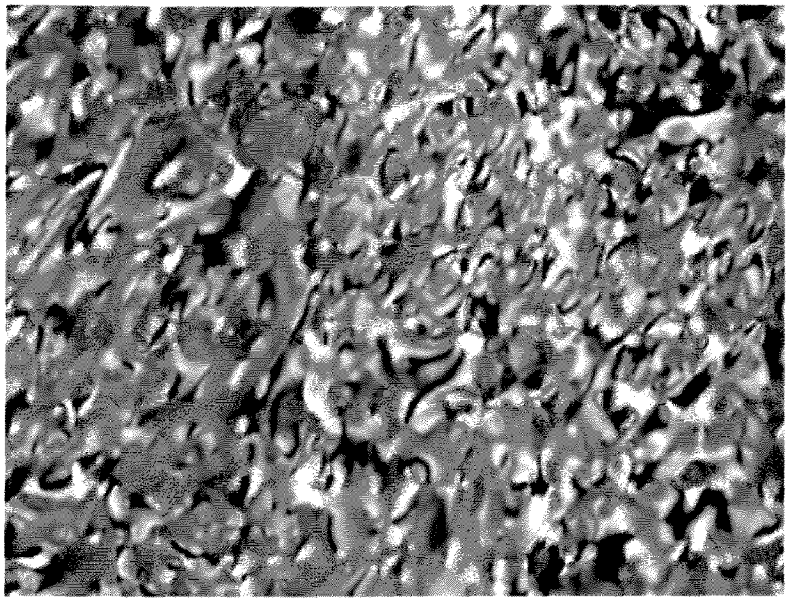
FIG. 3B is an optical microscopy image of coke produced from the retentate obtained from the ultrafiltration of the vacuum resid designated as Sample 2 in the Example. The image viewing area is 174×130 microns.
Figure 3A:
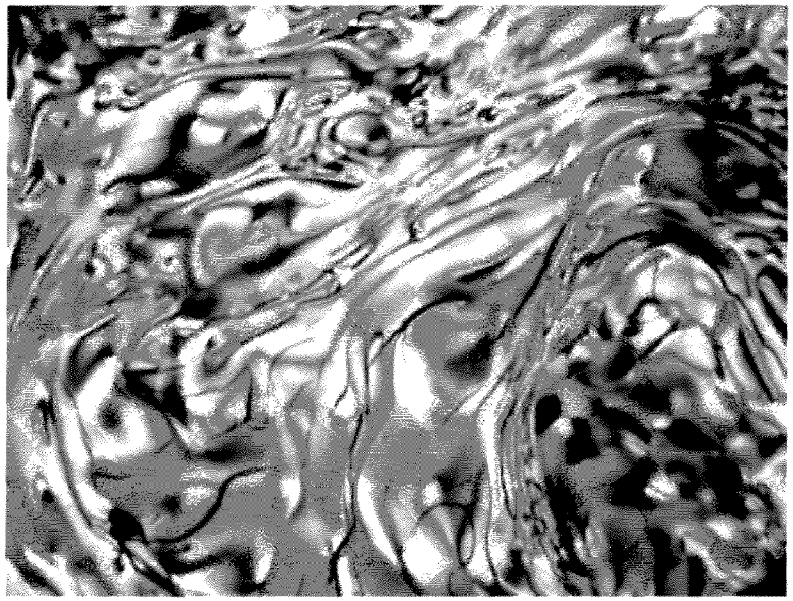
FIG. 3A is an optical microscopy image of coke produced from the vacuum resid designated as Sample 2 in the Example. The image viewing area is 174×130 microns.
Figure 4B:
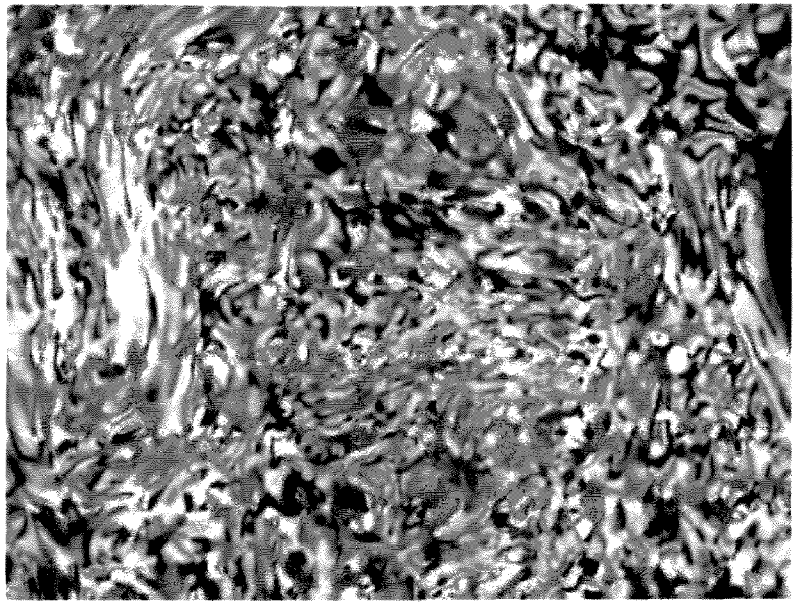
FIG. 4B is an optical microscopy image of coke produced from the retentate obtained from the ultrafiltration of the vacuum resid designated as Sample 3 in the Example. The image viewing area is 174×130 microns.
Figure 4A:
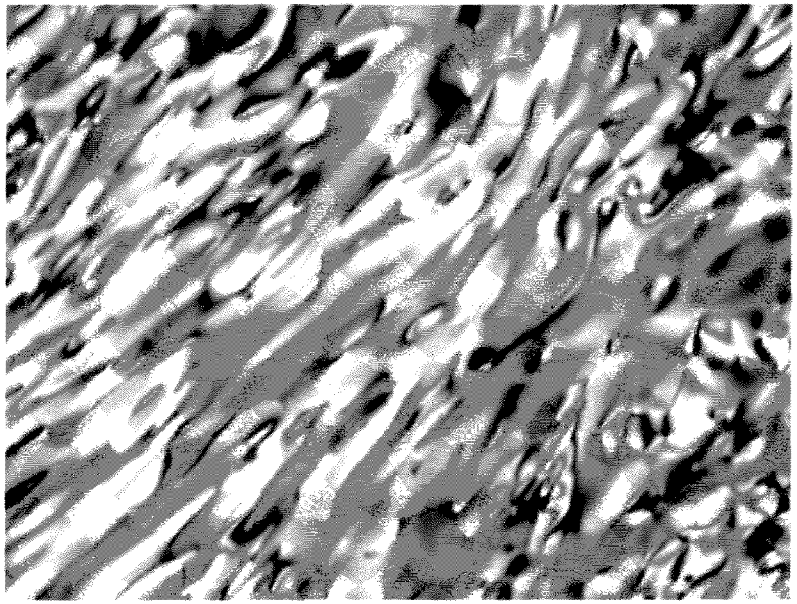
FIG. 4A is an optical microscopy image of coke produced from the vacuum resid designated as Sample 3 in the Example. The image viewing area is 174×130 microns.
Figure 5B:
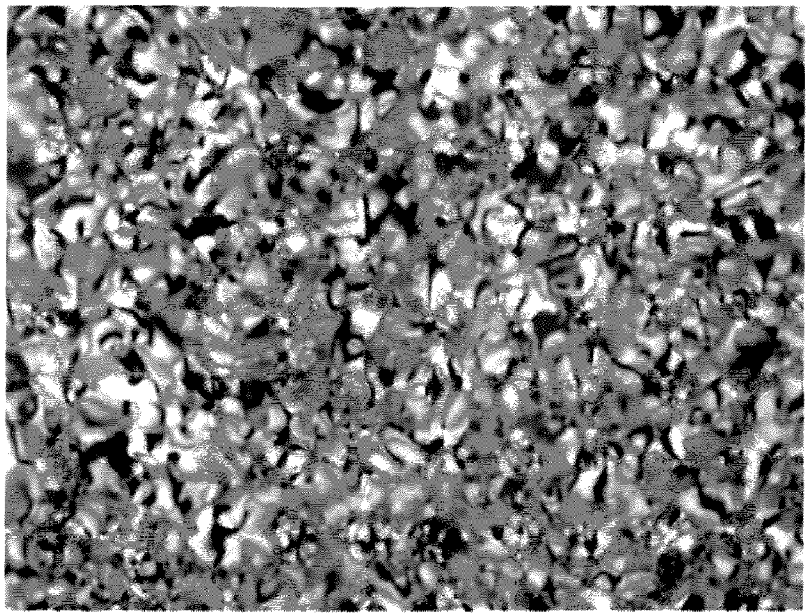
FIG. 5B is an optical microscopy image of coke produced from the retentate obtained from the ultrafiltration of the vacuum resid designated as Sample 4 in the Example. The image viewing area is 174×130 microns.
Figure 5A:
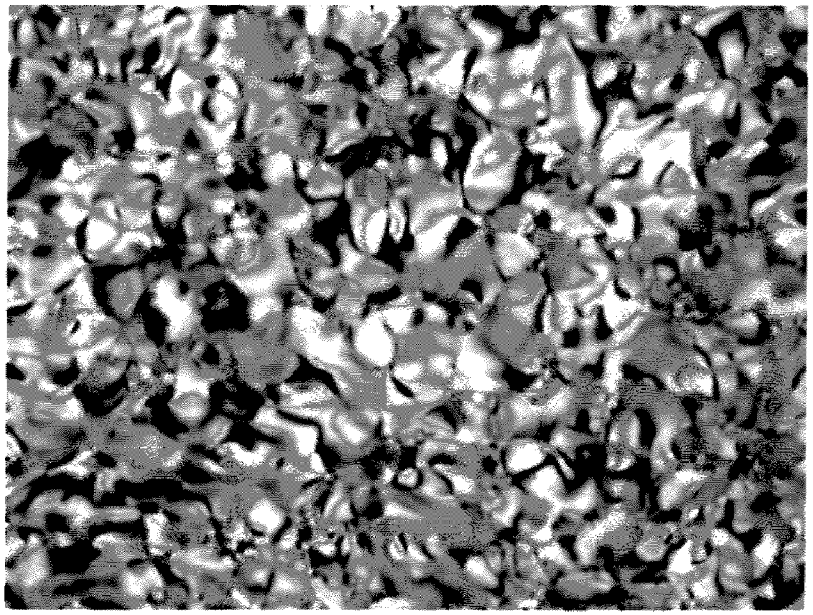
FIG. 5A is an optical microscopy image of coke produced from the vacuum resid designated as Sample 4 in the Example. The image viewing area is 174×130 microns.

Each of the seven vacuum resids samples and each of the seven retentate samples obtained from these vacuum resids were then subjected to a coking process simulated by a Micro Carbon Residue (MCR) test in accordance with ASTM Method D-4530 utilizing a 2 gram sample which provided a large enough sample for which to perform optical microscopy analysis of the produced coke. FIG. 2A shows the photomicrograph of the coke produced from the unseparated vacuum resid Sample #1; wherein, FIG. 2B shows the photomicrograph of the coke produced from the retentate obtained from the vacuum resid Sample #1. Similarly, FIGS. 3A and 3B show the coke obtained from unseparated feed and retentate of Sample #2, respectively. FIGS. 4A and 4B show the coke obtained from unseparated feed and retentate of Sample #3, respectively. FIGS. 5A and 5B show the coke obtained from unseparated feed and retentate of Sample #4, respectively.

TABLE 1

| | | | | Feed Properties | | | | Retentate | | | | | | | |
|---|---|---|---|---|---|---|---|---|---|---|---|---|---|---|---|
| | Trans-membrane Pressure | Feed-stream Temperature | Permeate Yield | CCR (wt | Ni | V | S | CCR | Ni | V | S | Increase Factor | | | |
| Sample | (psi) | (° C.) | (% of feed) | %) | (ppm) | (ppm) | (wt %) | (wt %) | (ppm) | (ppm) | (wt %) | CCR | Ni | V | S |
| Vacuum Resid Sample 1 | 1000 | 250 | 49 | 18.8 | 51 | 148 | | 28.4 | 86 | 245 | | 1.5 | 1.7 | 1.7 | |
| Vacuum Resid Sample 2 | 700 | 250 | 69 | 9.6 | | | | 19.2 | | | | 2.0 | | | |
| Vacuum Resid Sample 3 | 1000 | 250 | 66 | 13.9 | 71 | 3 | 0.25 | 29.4 | 169 | 6 | 0.33 | 2.1 | 2.4 | 2.3 | 1.3 |
| Vacuum Resid Sample 4 | 1000 | 250 | 50 | 23.1 | 51 | 160 | 4.5 | 32.2 | 89 | 270 | 5.21 | 1.4 | 1.7 | 1.7 | 1.2 |
| Vacuum Resid Sample 5 | 1000 | 250 | 81 | 13.6 | 29 | 64 | 1.37 | 36.7 | 106 | 221 | 1.93 | 2.7 | 3.6 | 3.4 | 1.4 |
| Vacuum Resid Sample 6 | 1000 | 250 | 60 | 17.4 | 41 | 109 | 1.9 | 28.0 | 83 | 209 | 2.19 | 1.6 | 2.0 | 1.9 | 1.2 |
| Vacuum Resid Sample 7 | 1000 | 250 | 63 | 15.9 | 41 | 122 | 2.21 | 25.8 | 86 | 251 | 2.57 | 1.6 | 2.1 | 2.1 | 1.2 |

Additionally, each sample was also subjected to a high-pressure ultrafiltration separations process utilizing an 8 kilo-Dalton cutoff ceramic membrane in batch filtration bench tests. The ceramic membrane used in the testing was estimated to have an average pore size in the range of about 6 to 8 nanometers. The Transmembrane Pressure and Feedstream Temperature conditions of the testing for each sample is shown in Table 1. The Permeate Yield, as a volumetric percentage of the feedstream to the membrane separations process, obtained from each sample is also shown in Table 1.

The retentate obtained from each membrane separations process test was sampled for the same properties as for the Feedstream. These results are also presented in Table 1. As can be seen, the Increase Factor of the CCR was at least 1.4

Figure 6B:
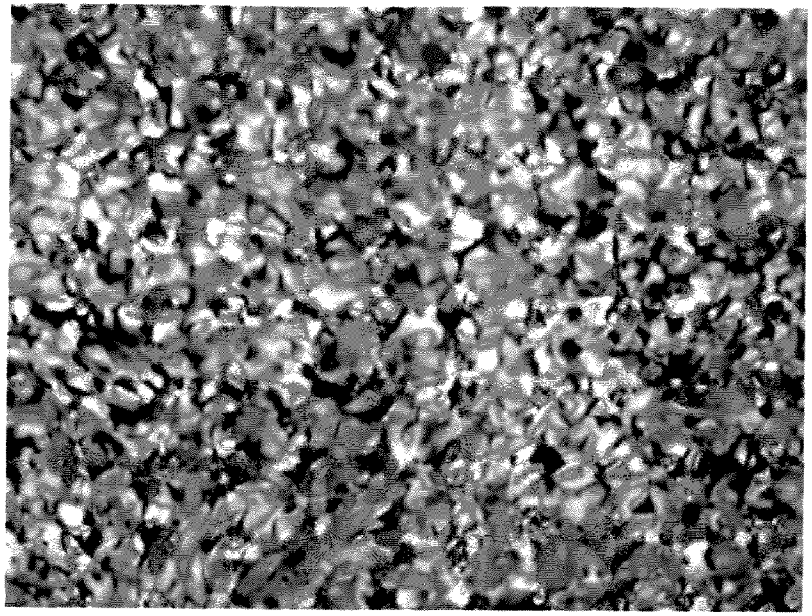
FIG. 6B is an optical microscopy image of coke produced from the retentate obtained from the ultrafiltration of the vacuum resid designated as Sample 5 in the Example. The image viewing area is 174×130 microns.
Figure 6A:
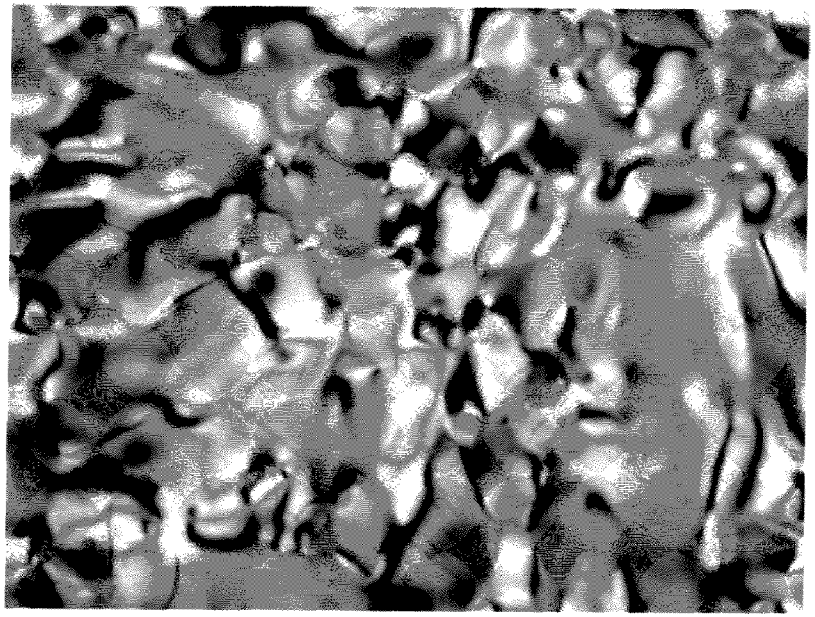
FIG. 6A is an optical microscopy image of coke produced from the vacuum resid designated as Sample 5 in the Example. The image viewing area is 174×130 microns.
Figure 7B:
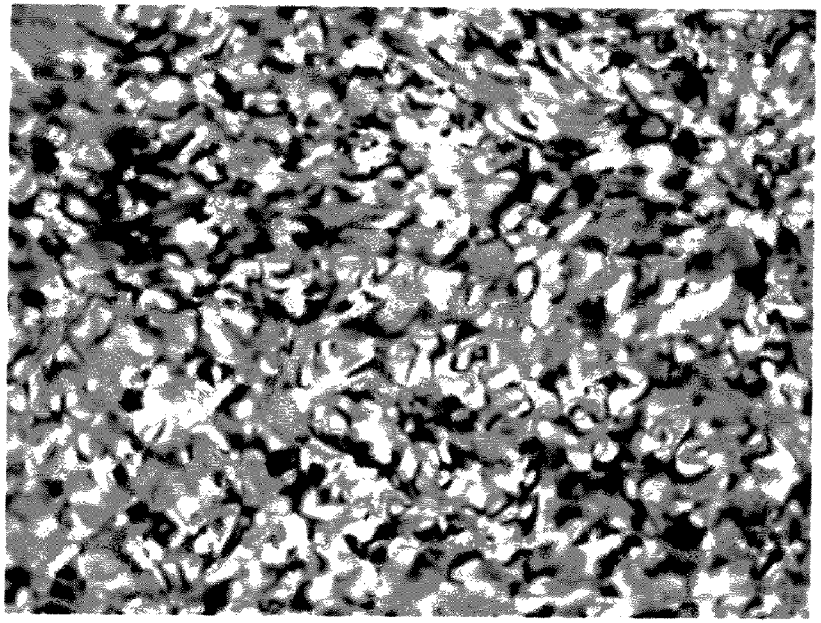
FIG. 7B is an optical microscopy image of coke produced from the retentate obtained from the ultrafiltration of the vacuum resid designated as Sample 6 in the Example. The image viewing area is 174×130 microns.
Figure 7A:
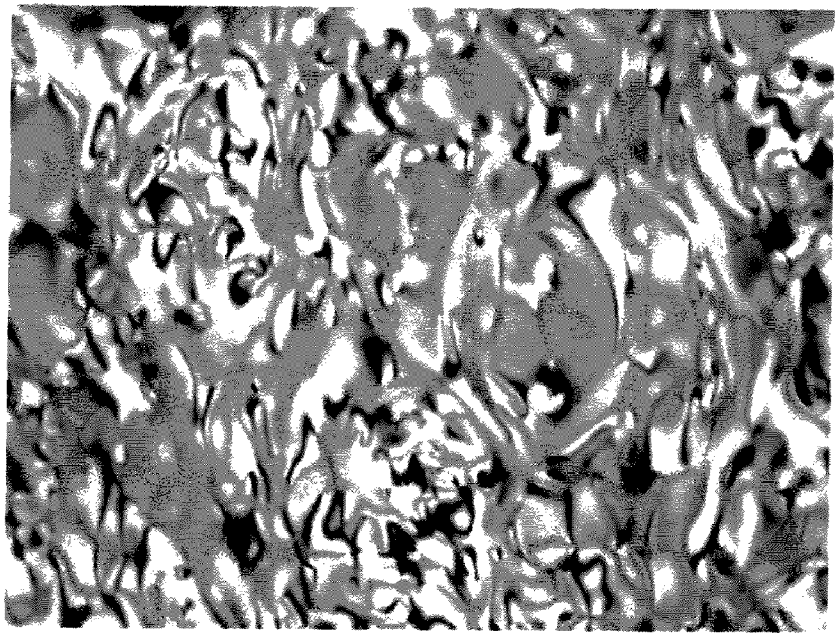
FIG. 7A is an optical microscopy image of coke produced from the vacuum resid designated as Sample 6 in the Example. The image viewing area is 174×130 microns.
Figure 8B:
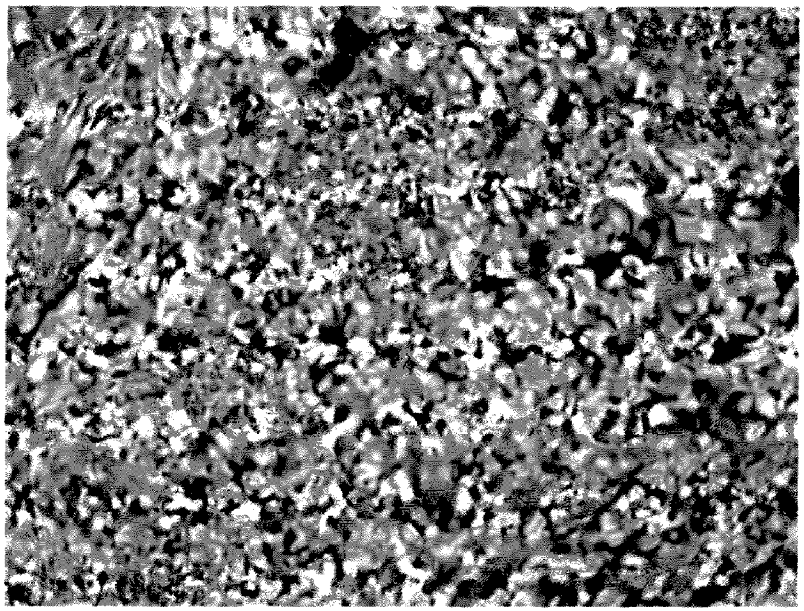
FIG. 8B is an optical microscopy image of coke produced from the retentate obtained from the ultrafiltration of the vacuum resid designated as Sample 7 in the Example. The image viewing area is 174×130 microns.
Figure 8A:
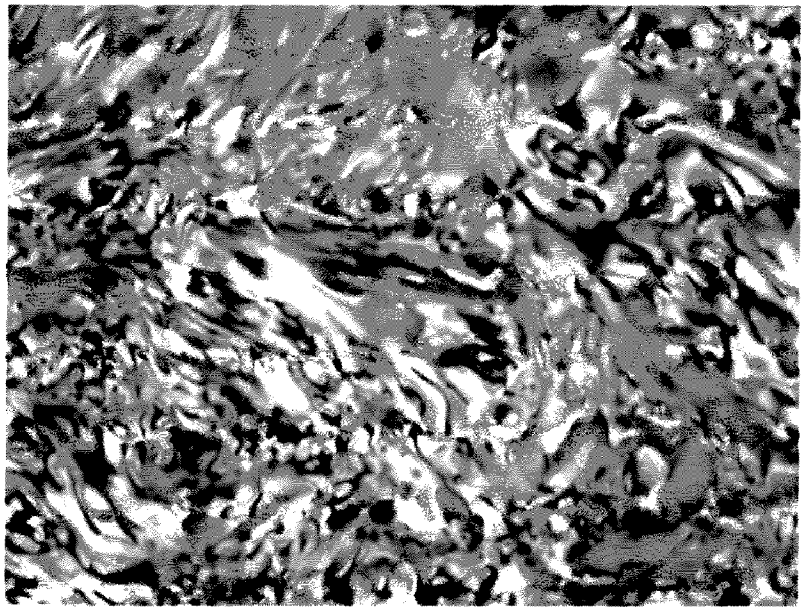
FIG. 8A is an optical microscopy image of coke produced from the vacuum resid designated as Sample 7 in the Example. The image viewing area is 174×130 microns.

FIGS. 6A and 6B show the coke obtained from unseparated feed and retentate of Sample #5, respectively. FIGS. 7A and 7B show the coke obtained from unseparated feed and retentate of Sample #6, respectively. Similarly, FIGS. 8A and 8B show the coke obtained from unseparated feed and retentate of Sample #7, respectively.

It is known by those skilled in the art that smaller flow domains and smaller mosaics in a coke sample track the tendency of the formation of shot coke. Cokes formed in this testing manner with domain and/or mosaic sizes less than about 10 microns are known to form a substantially free flowing coke in most delayed cokers. As can be seen in the optimal microcopy images in all of the coke samples in FIGS. 2A through 8B, the coke in the corresponding retentate samples show a much more granular composition which indicates the greater propensity to form shot coke. Although significant visual differences can be seen in the coke morphology in a comparison of all of the "A" and corresponding "B" microscopy images shown in the figures, the differences seen in comparing FIGS. 6A, 6B, 7A, 7B, 8A, and 8B corresponding to Samples 5, 6, and, 7 of the present example show an obvious difference in the coke morphology produced by the process of the present invention.

As demonstrated by this example, the process of the present invention can produce substantially free-flowing shot coke from a delayed coker unit. Additionally, this example demonstrates that the process of the present invention can produce a retentate product stream with significantly improved CCR content for use as a fluid coking unit feedstream.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process to produce a free-flowing shot coke, comprising:

a) conducting a feedstream consisting of a petroleum vacuum resid to a retentate zone of a membrane separations unit wherein the resid feedstream contacts a first side of at least one permeable membrane comprised of a ceramic, metal or a combination of ceramic and metal materials having an average pore size from 0.001 to 2 microns at a pressure of at least 300 psig and a temperature of 150 to 350° C.;

b) passing a portion of the resid feedstream from the first side of the membrane, through the membrane, to a second side of the membrane;

c) retrieving a permeate product from the second side of the membrane;

d) retrieving a retentate product stream from the first side of the membrane, wherein the CCR wt % content of the retentate product is greater than the CCR wt % content of the resid feedstream by a CCR Increase Factor (CCR wt % of retentate divided by CCR wt % of resid feedstream) of at least 1.2;

e) conducting at least a portion of the retentate product to a delayed coking unit and subjecting the retentate product to delayed coking in the unit; and f) obtaining a substantially free-flowing shot coke product from the delayed coking unit.

2. The process of claim 1, wherein the resid feedstream has a final boiling point of at least about 1100° F. (593° C.).

3. The process of claim 1, wherein the retentate product has a CCR Increase Factor of at least 1.4 as compared to the resid feedstream.

4. The process of claim 1, wherein the delayed coking unit is operated in a batch cycle mode.

5. The process of claim 1, wherein the retentate product has a Nickel Increase Factor of at least 1.5 and a Vanadium Increase Factor of at least 1.5 as compared to the resid feedstream.

6. The process of claim 1, wherein the transmembrane pressure across the membrane is at least 500 psig.

* * * * *